United States Patent [19]

Morlet et al.

[11] 4,036,568

[45] July 19, 1977

[54] MACHINES FOR MANUFACTURE OF POWDERS

[75] Inventors: Jean G. Morlet, Nevers; Yves C. Honnorat, Imphy; Gerard D. Raisson, Nevers, all of France

[73] Assignee: Creusot-Loire, Paris, France

[21] Appl. No.: 634,278

[22] Filed: Nov. 21, 1975

Related U.S. Application Data

[63] Continuation-in-part of Ser. No. 529,948, Dec. 5, 1974, abandoned.

[30] Foreign Application Priority Data

Dec. 7, 1973 France ..... 73.43735

[51] Int. Cl.[2] ..... B22D 23/08; B29C 23/00

[52] U.S. Cl. ..... 425/8; 264/5; 264/8; 264/10

[58] Field of Search ..... 425/8; 264/5, 8, 10

[56] References Cited

U.S. PATENT DOCUMENTS

| | | | |
|---|---|---|---|
| 2,189,387 | 2/1940 | Wissler | 264/10 |
| 2,897,539 | 8/1959 | McMillan | 425/8 X |
| 3,041,672 | 7/1962 | Lyle | 264/10 |
| 3,099,041 | 7/1963 | Kaufmann | 425/8 X |
| 3,119,685 | 1/1964 | Hansley et al. | 264/10 X |
| 3,752,610 | 8/1973 | Glazunov et al. | 425/8 X |
| 3,802,816 | 4/1974 | Kaufmann | 425/8 |
| 3,829,538 | 8/1974 | Darmara et al. | 425/8 X |

*Primary Examiner*—Robert L. Spicer, Jr.
*Attorney, Agent, or Firm*—Cameron, Kerkam, Sutton, Stowell & Stowell

[57] ABSTRACT

In the manufacture of metal and alloy powders in the form of small diameter spheres whose shape and diameter must be maintained within narrow limits, a substantially cylindrical solid electrode of the material from which the powder is to be made is rotated at high speed about its longitudinal axis and one end of the electrode is heated to fusion point, the molten material being sprayed therefrom under centrifugal forces in the form of small diameter spheres, wherein fusion of the one end of the electrode is obtained by means which produce a local fusion zone on the end surface of the electrode and means for causing the local fusion zone to move along a spiral path on the end surface of the electrode as the electrode rotates.

13 Claims, 9 Drawing Figures

MACHINES FOR MANUFACTURE OF POWDERS

RELATED U.S. APPLICATION

The application is a continuation-in-part of prior application Ser. No. 529,948, now abandoned, filed Dec. 5, 1974.

BACKGROUND OF THE INVENTION

The present invention relates to improvements in machines for manufacturing in large quantities metal and alloy powders in the form of small diameter spheres the shape and grain size of which must be controlled within narrow limits. There is in fact a market for such powders which are employed particularly for their low specific surface since the shape of a sphere is that which presents the lowest surface area as compared with its volume, but also for their propensity to move across a plane surface at constant acceleration under the influence of a force of given magnitude, whatever the direction of this force in the plane of motion.

A method of manufacturing such metal powders with predetermined shape and dimensions by spraying from a rotating electrode is described, for example, in U.S. Pat. No. 3,099,041. In accordance with this method an electrode which is cylindrical or nearly a cylinder of revolution, made of the metal or alloy from which it is required to make the powder, and which will hereafter be called the rotating electrode, is set in rapid rotation about its longitudinal axis. The rotating electrode is then progressively melted, the plane of fusion being one of the plane surfaces bounding the cylinder perpendicularly to its longitudinal axis. The fusion may be obtained by striking an electric arc between this surface of the rotating electrode and an electrode of refractory metal formed in accordance with one of the methods known to those skilled in the art and which will hereafter be called the non-consumable electrode. The centrifugal force created by the rotation of the rotating electrode causes spraying of the molten metal in the form of droplets, which droplets solidify and cool during the course of their free trajectory. The process of formation of the droplets is well known and relationship between the size of the powder grains and various operational parameters has been defined, for example, by a law of the following type:

$$d = \frac{k}{N}\sqrt{\frac{\gamma}{D\rho_L}}$$

where

- $d$ is the mean diameter of the grains of powder in microns,
- $k$ is a constant,
- N is the speed of rotation of the rotating electrode in r.p.m,
- $\gamma$ is the surface tension of the liquid metal from which it is required to make the powder in erg/cm$^2$,
- D is the diameter of the rotating electrode in cm.,
- $e_L$ the density of the liquid metal in g/cm$^3$.

In general a spraying device of this kind is located entirely within an enclosure which isolates it from the outer atmosphere and which enables it to be kept in an atmosphere which is neutral with respect to the metal or alloy to be sprayed, so as to avoid contamination of the powder by reactive gases such as oxygen and nitrogen. Putting the method into effect by means of the device that we have just described enables spherical powders of elemental analysis and controlled grain-sizes to be obtained from very diverse metals and alloys such as steels, alloys of nickel, cobalt, titanium, beryllium, niobium, molybdenum, tungsten, etc.

Known apparatus employing the method which we have just described are designed so that with fusion of the rotating electrode the distance between it and the non-consumable electrode remains substantially constant. An equidistance of this kind may be obtained by providing one of the two electrodes with a movement in translation parallel with the longitudinal axis of the rotating electrode. In one particular arrangement the non-consummable electrode is fixed and the rotating electrode is capable of being displace along its longitudinal axis. In another arrangement the rotating electrode is not capable of being displaced in translation, but the non-consumable electrode is displaced parallel with the longitudinal axis of the rotating electrode.

In all the know apparatus the non-consumable electrode is centred on the longitudinal axis of the rotating electrode or set slightly offcentre, but remains fixed in the plane perpendicular to the longitudinal axis of the rotating electrode. Such an arrangement limits the diameter of the rotating electrodes to a few centimeters at maximum (5 to 7 cm for a steel, for example). Indeed the zone which is brought to fusion point by the electric arc is limited to a circle of a few centimeters in diameter at the maximum. The liquid metal formed in this zone and carried away by the centrifugal force solidifies again before reaching the edge of the front surface of the consumable electrode if the diameter of the latter is excessive. In such a case the molten metal cannot be ejected in the form of droplets and one observes simply a hollowing of the central zone of the rotating electrode and a swelling of the peripheral zone.

In the simplest version of an apparatus operating in accordance with the above method the device for location of the rotating electrode is inside the airtight enclosure. The length of the rotating electrode is therefore limited by the dimension of the enclosure along the longitudinal axis of the rotating electrode but also by the disadvantages resulting from the overhang or free length of an electrode of rather small diameter rotating at high speed about its own axis, which speed is the higher the smaller the diameter of the electrode, as shown by the equation given above. Thus in order to obtain powders of 100$\mu$ from a rotating electrode of steel 65mm in diameter it is necessary to make it rotate at 10,000 r.p.m., and in order to avoid perceptible bending of the rotating electrode under the effect of the centrifugal force its length in overhang or free length is limited to 250mm which represents a consumable mass of a maximum of 6.5 kg. Hence the productivity of such an apparatus is low because of the necessity for frequently changing the rotating electrodes. Moreover the portion of the rotating electrode kept for attaching it to the driving device is not transformed into powder and represents a considerable proportion of the whole of the electrode. Finally the manufacture of the electrodes represents a considerable expense which is not paid off by a sufficient quantity of powder being manufactured.

With a view to alleviating the disadvantages resulting from the low unit mass of the rotating electrodes, two methods in particular have been proposed.

The first method, described in U.S. Pat. No. 3,802,816, consists in locating the driving system for the rotating electrode outside the airtight enclosure and making this system movable along the longitudinal axis of the rotating electrode. An airtight passage through the wall of the enclosure enables the rotating electrode to pass inside and its overhang or free length to be limited. Displacement of the driving system makes the electrode slide in the airtight passage in order to compensate for its progressive wear. The overhang or free length of the rotating electrode remains constant as it is sprayed away and limited to the length of the portion lying inside the enclosure. A method of this kind enables the length of the rotating electrodes to be substantially increased but this increase remains limited to three or four times that of the rotating electrodes employed in the simplest machines if the driving means is not to be excessively complicated. Again, it is necessary for the rotating electrode, which slides into the enclosure by way of a seal, to have a shape very nearly that of a perfect cylinder, which necessitates a particularly costly operation of machining by grinding.

The second method, described in U.S. Pat. No. 3,784,656 consists in employing as the rotating electrode a wire of great length. In order to communicate a sufficiently high centrifugal force to the molten metal the wire advances inside a rotating cylinder through a channel of section slightly greater than that of the wire, entering along the axis of rotation of the cylinder and leaving along an axis intersecting the axis of rotation at a large angle with respect to the latter so that the outlet orifice is offcentred with respect to the axis of rotation of the driving cylinder. The rotating system is thus equivalent to a rod of diameter much greater than that of the wire. The main disadvantage of this second method is that it requires the conversion of the metal or alloy to be sprayed into wire, which is in any case costly and is impossible for a number of metals or alloys the plasticity of which is insufficient to lend itself to known methods of wiredrawing.

In other known modifications of the above basic principle, the non-consumable electrode causing local fusion of the rotating electrode is replaced by other known means enabling the rotating electrode to be heated locally up to fusion point. Such known means may be a plasma torch or an electron gun which have been employed to enable fusion of materials which are poor conductors of electricity or the fusion temperature of which is particularly high. The apparatus using such modifications is designed on the same principles as those which we have described above and display the same disadvantages connected with limitation of weight, dimensions and form of the rotating electrodes.

SUMMARY OF THE INVENTION

The invention is applicable to apparatus enabling manufacture of spherical powder of controlled grain size consisting of spherical particles having a diameter between 10 and 1000 microns by progressive fusion and centrifuging of the material melted at the free end of a rotating electrode consisting of the material from which it is required to make the powder. The main components of such an apparatus are:

A gastight enclosure, in general watercooled, which enables the operations of fusion, centrifugal spraying, solidification and cooling to be carried out screened from the reactive gases in the atmosphere.

Means for driving the rotating electrode in rapid rotation so that the electrode, which takes the form of a cylinder of revolution, rotates about its longitudinal axis to constantly present a free end and communicates to the liquid material formed at the free end of the electrode a centrifugal acceleration.

Means enabling local heating to the fusion point of the free end of the electrode such means being advantageously constituted by either a non-consumable electrode enabling an electric arc to be maintained between it and the free end of the rotating electrode, a plasma torch, or an electron gun.

Means enabling, as the rotating electrode fuses, the preservation of the initial configuration of the free end of the electrode and the local fusion means so as to perpetuate the process of wear by local fusion of the rotating electrode.

It is an object of the invention to improve apparatus and methods as described above to make them suitable for spraying rotating electrodes of considerable weight and diameter so as to reduce the cost of manufacture and increase the productivity of such machines. It is a particular object of the invention to provide an apparatus in which rotating electrodes can be employed, the diameter and weight of which are no longer as severely limited by the stresses connected with the overhang as described above. By way of example, spherical particles 100$\mu$ in diameter may be produced in accordance with the invention from rotating electrodes of 250mm diameter and 300kg weight which can be manufactured without any particular difficulty and at low cost by casting and machining techniques known to those skilled in the art.

It is a further object of the invention to provide an apparatus including means enabling the zone of impact of the heat flow produced by the local fusion means to be displaced slowly across the free end of the rotating electrode. The combination of this slow displacement with the rapid rotation of the rotating electrode leads to the local fusion zone having a spiral motion, which, if the trajectory of the slow displacement is suitably chosen, involves the whole of the surface of the free end of the electrode whatever its diameter.

In the case where the local fusion means comprises a non-consumable electrode enabling an electric arc to be maintained, or a plasma torch, the local fusion means is attached to a shaft the axis of which is parallel with the longitudinal axis of the rotating electrode but offset with respect to this axis by an amount at least equal to half the radius of the rotating electrode. Attachment of the local fusion means to this shaft is ensured by means of an arm perpendicular to this shaft and hence perpendicular to the longitudinal axis of the rotating electrode. The length of this arm is equal to the distance between the two parallel axes mentioned above. Thus a slow rotation of the shaft bearing the local fusion means ensure a slow displacement of the latter in accordance with the preceding paragraph, and the combination of this slow displacement with the rapid rotation of the electrode enables the whole of the free end of the rotating electrode to be swept progressively by the local fusion zone.

In the case where the local fusion means is an electron gun, a first electrostatic or electromagnetic lens enables concentration of the electron beam on the free end of the electrode so as to create a local fusion zone. A second electrostatic or electromagnetic lens enable the electron beam to be deflected slowly in a plane containing the longitudinal axis of the rotating electrode. Thus the slow deflection of the electron beam ensures slow displacement of the local fusion zone and the combination of this displacement with the rapid rotation of the rotating electrode enables the whole of the surface of the free end of the electrode to be swept progressively by the local fusion zone.

Besides the advantages of the invention mentioned above, it provides, with respect to the known apparatus, other important advantages as follows:

As a rotating electrode of large diameter is able to have a heavy weight without running to excessive length, the means for rotating the rotating electrode may be located inside the air tight enclosure without the dimensions of the latter being exaggerated, which is the simplest arrangement. In short, one can avoid in this way passing the rotating electrode through an air tight passage and consequently the necessity for special machining of the surface of the electrode.

The use of rotating electrodes of large diameter, according to the law referred to above, enables lower speeds of rotation to be used for equal powder grain size, which leads to simplification of the design of the rotary drive means (and hence a reduction in its cost), and eliminates the problems posed by deformation of the rotating electrode because of the greater rigidity of the electrode.

With fairly low linear speeds of wear of the rotating electrode, of the order of one centimetre per minute for electrodes of 250mm diameter, control of the operation is very easy even though the instantaneous speed of production of powder can be high, e.g. of the order of several kg/min.

Figure 4:
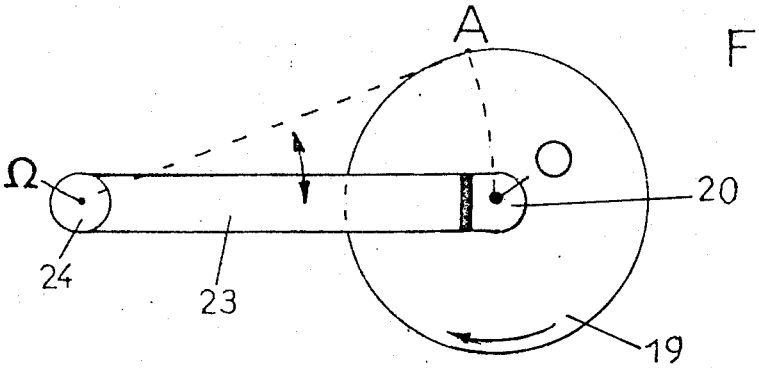
Figure 5:
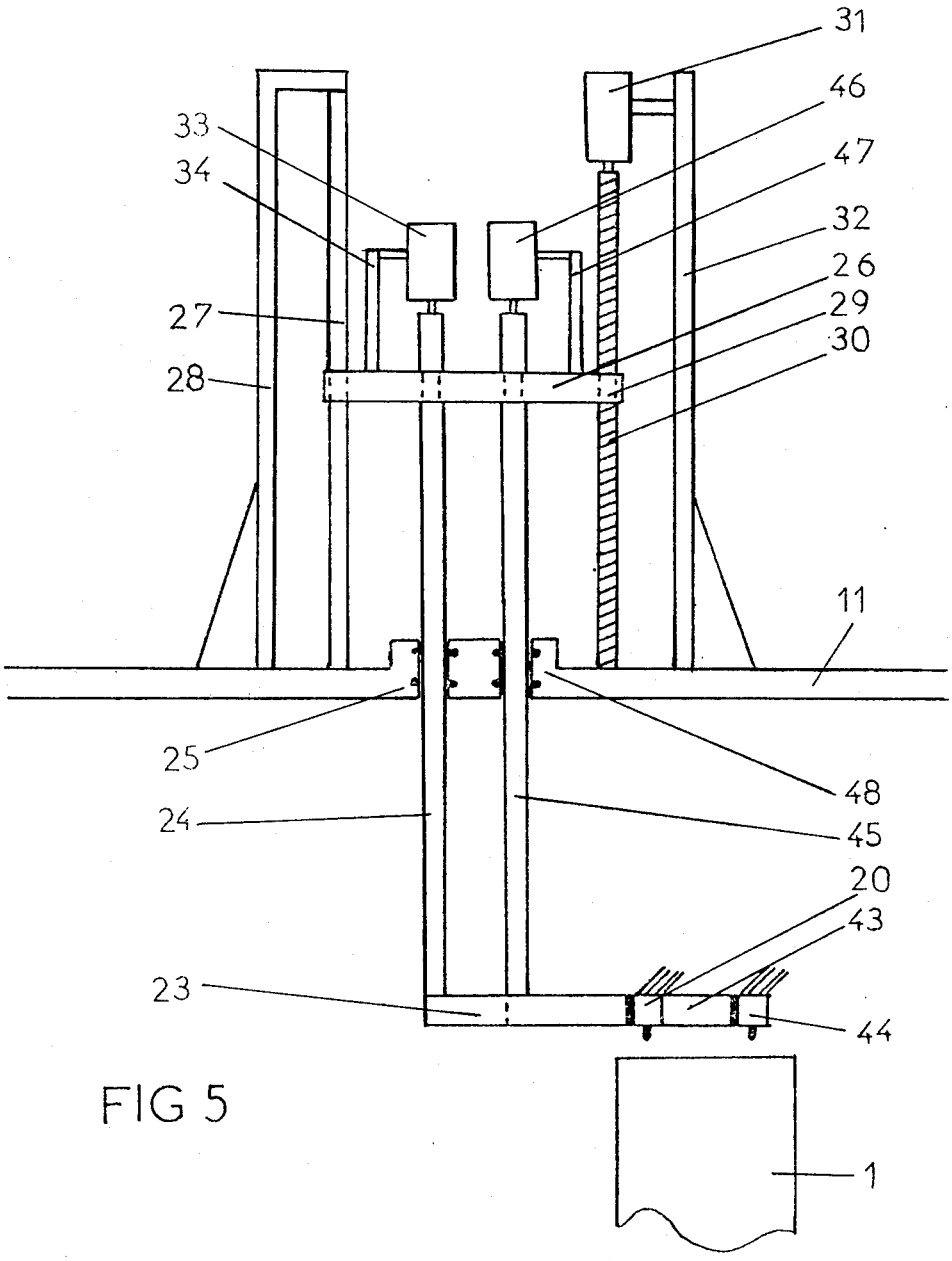
Figure 6:
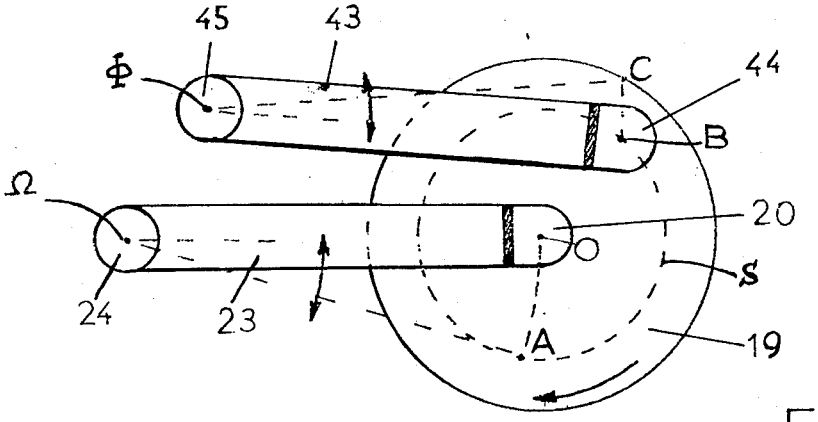
Figure 8:
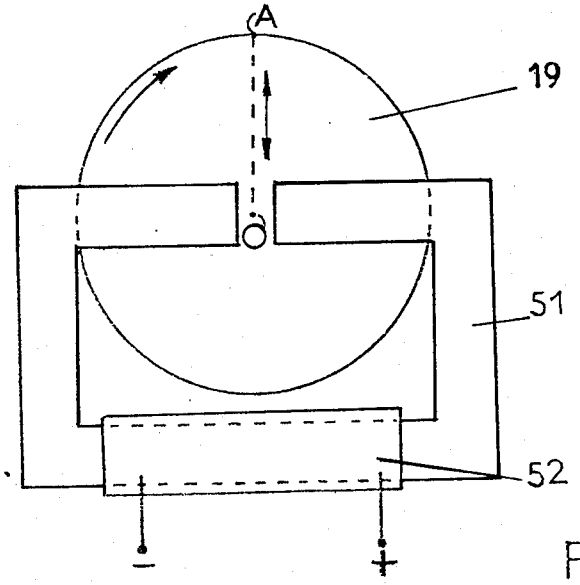
Figure 7:
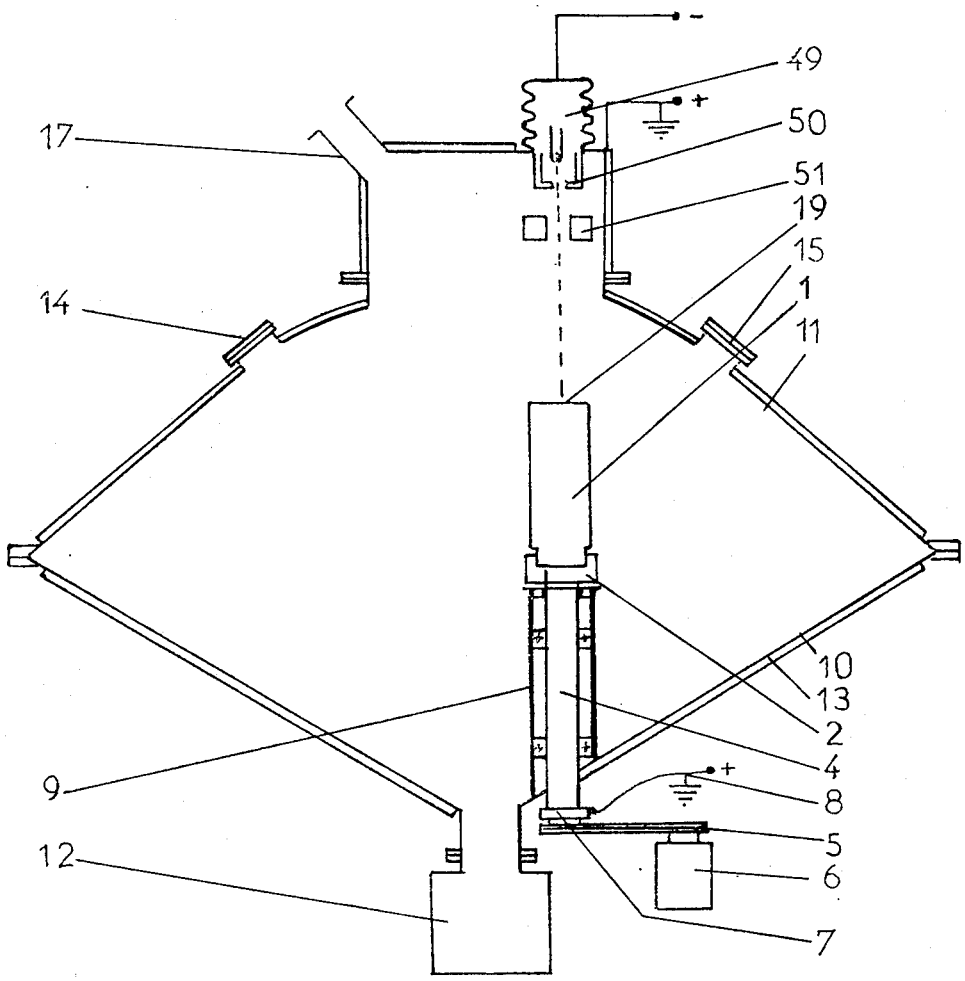

FIG. *3a* is a diagrammatic view of a non-consumable electrode;

FIG. *3b* is a diagrammatic view of a plasma torch head;

FIG. 4 is a view in a plane perpendicular to the longitudinal axis of the rotating electrode, of a local fusion means comprising an electric arc;

FIG. 5 is a diagrammatic view of means for displacing two non-consumable electrodes when the local fusion means consists of two electric arcs;

FIG. 6 is a view in a plane perpendicular to the longitudinal axis of the rotating electrode, of a local fusion means comprising two electric arcs;

FIG. 7 is a general view of an apparatus when the local fusion means comprises an electron beam; and FIG. 8 is a view in a plane perpendicular to the longitudinal axis of the rotating electrode, of a local fusion means comprising an electron beam.

DETAILED DESCRIPTION OF THE INVENTION

Figure 1:
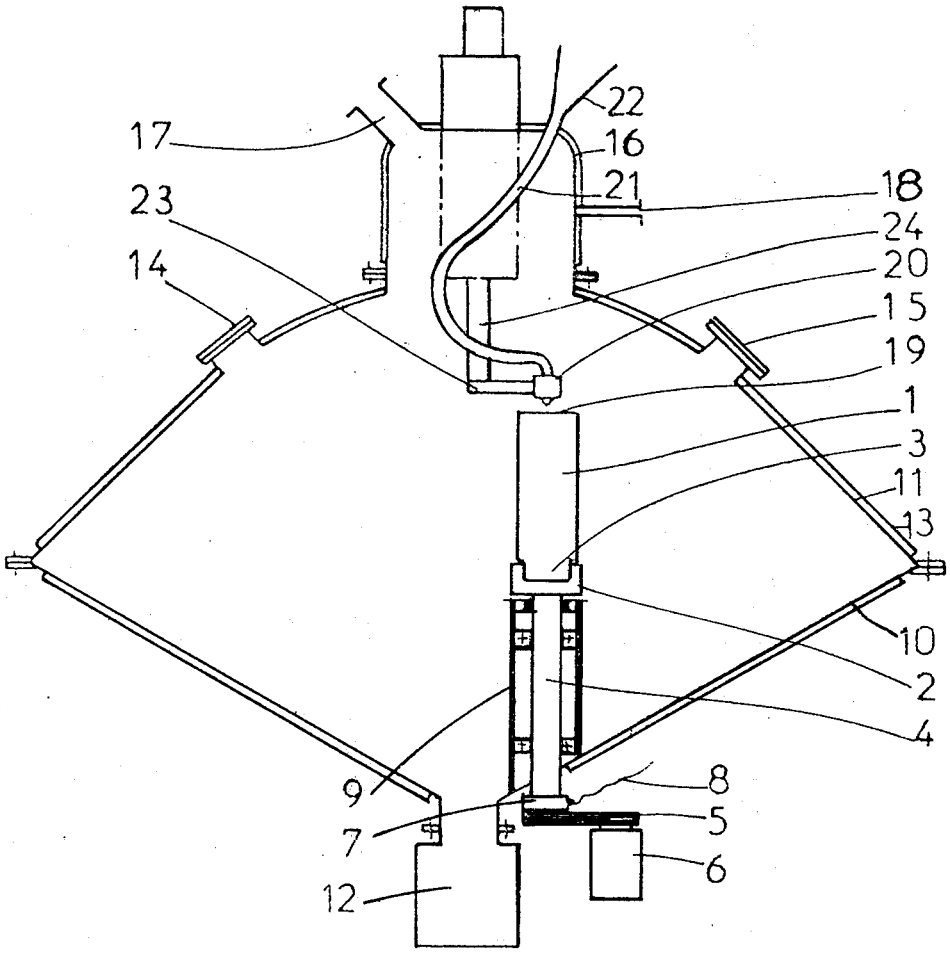
FIG. 1 is a general view of an embodiment of apparatus in accordance with the invention and including a local fusion means comprising an electric arc.

FIG. 1 illustrates the general concept of a preferred embodiment of apparatus according to the invention which will be described in detail hereafter according to the nature of the local fusion means.

As shown a rotating electrode 1 is attached to a mandrel 2 by way of a neck 3 machined at one end of the rotating electrode. The mandrel 2 is connected by a transmission shaft 4 and perpendicular gearing 5 to a motor 6 whose speed is variable from 500 to 5000 r.p.m. A bronze disc and a system of graphite brushes 7 enable the shaft 4 to be connected electrically to the positive pole of a direct current generator (not shown), by way of electric cable 8. The rotating electrode 1 is brought to a suitable height in air tight enclosure 13 by means of a sleeve 9 with watercooled walls. The common axis of the sleeve 9 and the rotating electrode 1 is slightly offset with respect to the axis of the air tight enclosure 13 to enable location of a powder receiver 12 where the powder collects at the centre of the bottom portion of the air tight enclosure 13.

The air tight enclosure 13 has a general form of revolution and is entirely cooled by water-circulation except at the few places where this is not possible (portholes, flanges, airtight ways). In the enclosure the trajectory of the droplets and grains of powder during the course of a spraying operation is always orthogonal to the longitudinal axis of the rotating electrode 1. For the particles or grains of powder to be spherical it is necessary that their first path without impact should be sufficiently long. In short, it is necessary that the droplets escaping from the free end of the rotating electrode be solidified, and that the grains of powder be cooled, before impact so that their impact against the walls of the enclosure does not cause bursting or deformation of the grains. It follows that it is necessary that the dimensions of the enclosure in a direction perpendicular to the longitudinal axis of the rotating electrode be sufficient, and preferably the radius of the enclosure lies between 1 and 2.50 meters in that portion of it subjected to the first impact of the particles. Again, the walls subjected to the first impact of the particles are inclined with respect to the trajectory of the latter so that the impact of the grains against the walls do not make them rebound in the direction of the local fusion device or of the free end of the rotating electrode to which they might adhere. The top portion 11 of the air tight enclosure includes two portholes 14 and 15 suitably protected against the thermal and ultraviolet rays, which portholes are used for observation of the fusion and for control of the operation. A collar 16 which caps the top portion of the air tight enclosure is equipped:

with an aperture 17 connected to a pump (not shown) and intended for evacuating the air tight enclosure of atmospheric gases;

with an aperture 18 enabling, after the enclosure has been evacuated, filling of the enclosure with a gaseous atmosphere which is neutral with respect to the rotating electrode 1. The protective gas may be He, $H_2$, $N_2$, A or a mixture of these gases, or any other gas or gaseous mixture chosen in dependence on the metal or alloy which it is required to spray;

with an air tight passage enabling sliding of the shaft or shafts bearing the local fusion means 20;

with an airtight passage enabling a cable or cables 22 to pass through, which cables are provided for feeding of the local fusion means 20 with fluid (gas, water, electricity).

DESCRIPTION OF THE ARRANGEMENT PREFERRED IN THE CASE WHERE THE LOCAL FUSION MEANS COMPRISES AN ELECTRIC ARC.

The electric arc is struck between the free end 19 of the rotating electrode 1 and a watercooled non-consumable electrode 20 of tungsten or thoriated tungsten. Cooling water and electric current circulate through two cooled cables 21 which pass through the collar 16 by an airtight passage insulated electrically from the air tight enclosure 13. The electrical circuit is closed when the arc is established by the conductor cable 22 connected to the negative pole of a direct current generator (not shown).

The head of the non-consumable electrode 20 is connected mechanically to an arm 23 whilst being insulated electrically from this arm. The arm 23 is integral with a shaft 24 which passes through the top portion 11 of the enclosure by an air tight sliding passage 25 and may be moved in translation and rotation by means of two devices located outside the enclosure and which are illustrated in FIG. 2.

Figure 2:
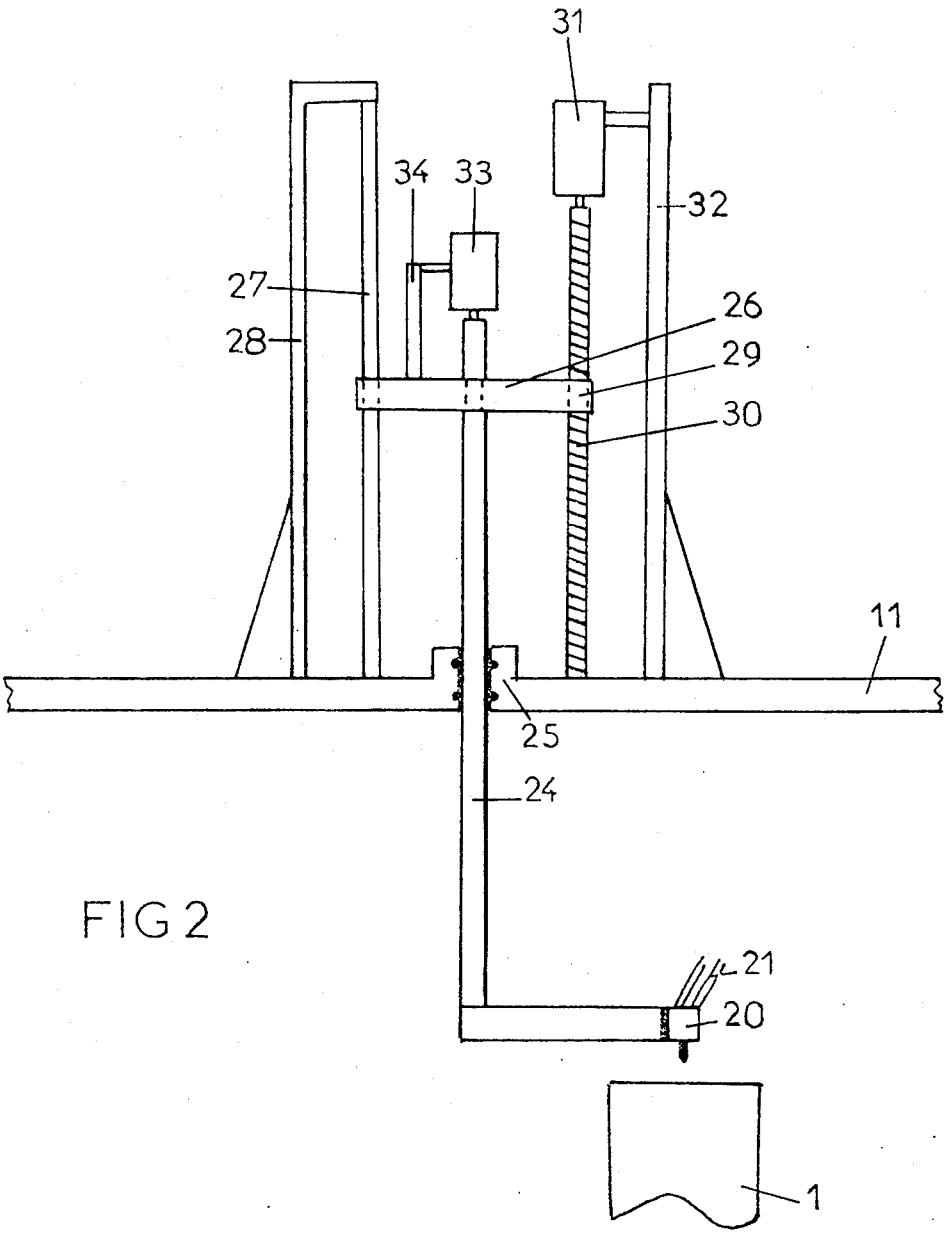
FIG. 2 is a diagrammatic view of means for displacing a non-consumable electrode when the local fusion means is an electric arc.

As shown in FIG. 2 the shaft 24 which carries the non-consumable electrode 20 is moved in translation by a reversible electric motor 31 and in rotation by a reversible electric motor 33. The motion of translation is effected by means of an endless screw 30 and a carriage 26 provided with a nut 29 engaged with the screw 30. The carriage 26 is guided by a guide rod 27 which in turn is made integral with the top portion of the enclosure 11 by means of a bracket 28. A bracket 32 plays a similar part with respect to the motor 31 and the endless screw 30. Rotation is effected by a motor 33 supported on the carriage 26 by means of the bracket 34.

Figure 3A:
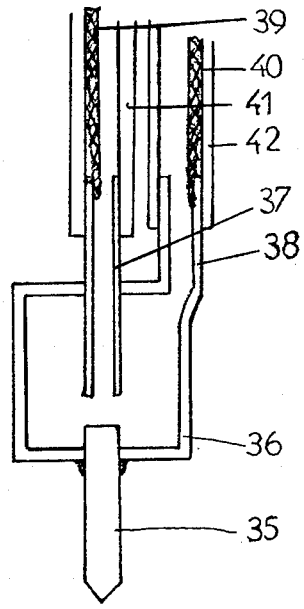

The construction of the cooled head of the non-consumable electrode is shown in FIG. 3*a.* The non-consumable electrode proper 35 consisting of a rod of tungsten or thoriated tungsten is brazed onto a copper chest 36 to which water is supplied by a pipe 37, the water leaving leaves by a pipe 38. Electrically conductive braids 39 and 40, preferably of copper, are brazed to the inlet and outlet of the chest 36 and located respectively inside flexible pipes 41 and 42. The two units 37, 39, 41 and 38, 40, 42 form the cooled cables 21 which were mentioned above.

FIG. 4 shows in detail the relationship between the rotating electrode and the non-consumable electrode. The axis Ω of the shaft 24, bearer of the non-consumable electrode 20, is parallel with the axis O of the rotating electrode which is seen from its free end 19. The two axes Ω and O are separated by a distance equal to three times the radius of the rotating electrode. A is the point of intersection of the circle of radius Ω O with the circle forming the visible outline of the free end 19. The arm 23 is adapted to be driven by the shaft 24 from the position Ω O to Ω A. Its length is adjusted so that the non-consumable electrode 20 passes effectively vertically above O and A. The slow oscillation of the arm 23 between the extreme positions Ω O and Ω A during the rapid rotation of the rotating electrode about O enables sweeping of the whole surface of the free end 19 in a spiral by the local fusion zone when the electric arc is maintained between the non-consumable electrode 20 and the free end 19 of the rotating electrode.

DESCRIPTION OF THE ARRANGEMENT PREFERRED IN THE CASE WHERE THE LOCAL FUSION MEANS COMPRISES A PLASMA TORCH

Figure 3B:
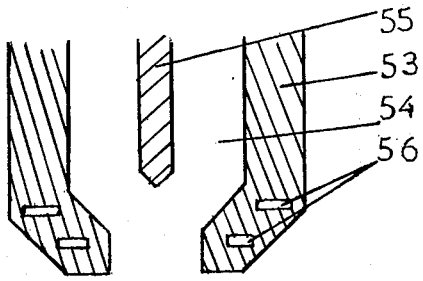

The head bearing the non-consumable electrode 20 is replaced by a plasma torch head the principle of which, known to those skilled in the art, is illustrated in FIG. 3*b.* This head comprises a non-consumable electrode 55 of tungsten or thoriated tungsten and cooled by water on the same principle as that described with reference to FIG. 3*a,* and an annular copper part 53 cooled by water flowing through circulation channels 56. Into the annular gap 54 is injected a gas such as A, He, $H_2$, $N_2$ or a suitable mixture of these gases.

This torch head may advantageously be employed in two different ways:

In transferred-arc operation the electric arc is struck between the non-consumable electrode 55 and the free end of the rotating electrode. With a plasma torch head the starting of the arc is much simpler than with an electric arc as described above. Moreover the arc voltage is higher, which enables either the intensity of the arc to be limited or at equal intensity the heating power to be increased and hence the process of fusion to be accelerated.

In blown arc operation the electric arc is struck between the non-consumable electrode 55 and the cooled annular copper part 53. This arc is used to heat the gas injected into the annular gap 54 which in turn ensures heating of the local fusion zone of the rotating electrode. With this arrangement besides the advantages mentioned above, it is possible to transform into powder electrodes whose electrical conductivity is very low.

When the local fusion device is a plasma torch head the injection of gas made to ensure the operation of the torch necessitates the addition to the airtight enclosure of an exhaust valve preventing the pressure in the enclosure from exceeding too high a value. Apart from this the apparatus is in accordance with the previous description and the principle of operation is as described above where the local fusion means comprises an electric arc.

DESCRIPTION OF THE ARRANGEMENT PREFERRED IN THE CASE WHERE TWO ELECTRIC ARCS ARE EMPLOYED SIMULTANEOUSLY

It may be advantageous for spraying of rotating electrodes of large diameter to employ two electric arcs simultaneously in order to create two local fusion zones at the free end of the rotating electrode. In this case each local fusion zone is in a different portion of the surface of the free end of the electrode and the process of fusion and spraying of the rotating electrode is thus accelerated. Using a single electric arc it is difficult to use a power greater than 50 kilowatts so that the instantaneous speed of production is limited to 4 kg/min in the case of a steel rotating electrode. In the case where two electric arcs are used simultaneously the instantaneous speed of production may be increased to 10 kg/min and the diameter of the rotating electrodes, which is limited to 150mm with the apparatus described in the preceding paragraph, may be increased to 300mm.

Where two electric arcs are used, the local fusion means is arranged as shown in FIG. 5. The carriage 26 is translationally fast with two shafts 24 and 45 which pass through the top portion of the enclosure by two airtight passages 25 and 48. These two shafts are displaced together in the direction of their axes by the endless screw 30 and the reversible motor 31. The two shafts 24 and 45 are respectively integral with two arms 23 and 43 which respectively support two non-consumable electrodes 20 and 44. The feeds to the non-consumable electrodes 20 and 44 are independent.

The two shafts 24 and 45 are respectively driven in rotation about their longitudinal axes by two variable-speed reversible electric motors 33 and 46, which in turn are supported on the carriage 26 by brackets 34 and 47.

FIG. 6 shows in detail the relationship between the rotating electrode and the two non-consumable electrodes 20 and 44. The axes of the two arms 24 and 45 respectively Ω and ϕ, are parallel with one another and parallel with the axis O of the rotating electrode which is seen from its free end 19. The length of each of the two arms 23 and 43 is calculated as has been described with reference to FIG. 4. In order to adjust the angle of clearance of each of the two arms 23 and 43 the front face of the free end 19 is considered as divided up by a theoretical circle S of centre O such that this circle defines on the front face of the said free end 19 two surfaces of substantially equal area. The non-consumable electrode 20 acts inside the circle S and the non-consumable electrode 44 acts on the part of the surface lying between the circle S and the visible outline of the free end 19. The non-consumable electrode 20 pivots between the limit positions at O and A, A being the intersection between the circle S and the projection of the circle traversed by the centre of the non-consumable electrode 20 in its rotation about the axis Ω. Similarly the non-consumable electrode 44 pivots about the axis ϕ so that the projection of the centre of the electrode onto the plane of the Figure cuts respectively at B and C the circle S and the visible outline of the free end 19. The slow rotation of the non-consumable electrode 20 between its limit positions O and A associated with the rapid rotation of the rotating electrode enables spiral sweeping of the whole of the part of the surface of the free end 19 lying inside the circle S by the local fusion zone when the electric arc is maintained between the non-consumable electrode 20 and the free end 19. The same applies as far as the effect is concerned of the motion of the non-consumable electrode 44 between the points B and C relative to the area lying between the circle S and the visible outline of the free end 19. Thus the combination of the rapid rotation of the electrode 19 and the slow oscillatory motions of each of the electrodes 20 and 44 enables progressive fusion to be ensured across a substantially plane surface of the free end 19 of the rotating electrode.

The two oscillatory motions are combined so as to avoid any contact whatever between the two electrodes as well as overlapping of their areas of sweep. The motion of translation of the carriage 26 enables the progressive wear of the rotating electrode to be compensated for and the lengths of the electric arcs to be controlled at each moment.

DESCRIPTION OF THE ARRANGEMENT PREFERRED IN THE CASE WHERE THE LOCAL FUSION MEANS CONSISTS OF TWO PLASMA TORCHES EMPLOYED SIMULTANEOUSLY

For the same reasons that prompt the employment where necessary of two electric arcs instead of only one, it is in certain cases advantageous to employ simultaneously two plasma torches instead of only one. In this case the particular arrangements relative to the employment of one plasma torch instead of one electric arc, together with the particular arrangements relative to the use of two non-consumable electrodes instead of only one, enable the arrangement of an apparatus using two plasma torches employed simultaneously to be deduced. Similarly the operation of such a machine is easily deduced from the preceding description.

DESCRIPTION OF THE ARRANGEMENT PREFERRED IN THE CASE WHERE THE LOCAL FUSION MEANS IS AN ELECTRON GUN

Instead of non-consumable electrodes or plasma torches it may be advantageous to employ an electron gun as the local fusion means, in particular where it is preferred to bring the material of the rotating electrode to fusion under vacuum rather than in the presence of a gas, even a neutral one. The electron gun emits an electron beam which is employed as the means of local fusion, under high vacuum. A preferred arrangement of an apparatus in which the local fusion means is an electron gun is shown in FIG. 7. In this apparatus the power of the electron gun 49 is 100 kilowatts, equivalent to the maximum power that can be installed with an assembly of two non-consumable electrodes in the manner described above. The collar 16 at the top of the previously described enclosure 11, as well as all the accessories that it carries, are modified in this apparatus. All the other portions of the apparatus remain the same, in particular the rotary drive means and the powder collector device 12.

The collar 16 carries a neck 17 connected to a pump set (not shown), enabling putting of the airtight enclosure under secondary vacuum, an electron gun 49 and an electromagnet 51. The electron gun 49 includes a diaphragm 50 which limits and focuses the image of the electron beam on the free end 19 of the rotating electrode 1 to a few centimeters diameter (preferably 1 to 2 cm), this image constituting the local fusion zone.

FIG. 8 illustrates the operation of the electromagnet 51. It is excited by a coil 52 fed with direct current of variable intensity. When the current passing through the coil 52 has its minimum intensity the assembly consisting of the electromagnet 51, the diaphragm 50 and the electron gun 49 is adjusted so that the image of the electron beam on the free end 19 of the rotating electrode is formed at the central point O. When the current passing through the coil 52 has its maximum intensity the induction in the gap of the electromagnet is brought to its maximum value and the electron beam forms its image at the edge of the free end 19 at the point A. It will be understood that by making the excitation current of the coil 52 vary slowly between these two extreme values the local fusion zone is displaced progressively from O to A and vice versa. The combination of this motion with the rapid rotation of the rotating electrode brings about a spiral sweep of the local fusion zone which, when the apparatus is suitably adjusted, affects the whole of the free end of the rotating electrode and enables its uniform wear.

What is claimed is:

1. Apparatus for manufacturing metal powder consisting of spherical particles having a diameter between 10 microns and 1000 microns, by spraying molten metal from the end surface of one end of a consumable substantially cylindrical solid metal electrode rotated at high speed about its longitudinal axis, the apparatus comprising:

means for rotating said consumable electrode about said axis and at high speed;

means for locally heating at least one zone of said end surface of said one end of said consumable electrode to fusion point;

means for relatively moving said consumable electrode and said local fusion zone to compensate for consumption of said consumable electrode, whereby when said rotating means is energized and said electrode is rotated at high speed, said fusion zone moves across said end surface of said consumable electrode in a spiral path, metal liquified thereby is expelled centrifugally from said end of said consumable electrode in the form of metal droplets; means for cooling said droplets and means for recovering said metal droplets when cooled.

2. Apparatus according to claim 1, wherein said heating means comprises means for locally heating a single zone of said end surface of said consumable electrode and said moving means cause said local heating zone to move across the whole of said end surface of said consumable electrode.

3. Apparatus according to claim 1, wherein said heating means comprises means for locally heating two zones of said end surface of said consumable electrode and said moving means cause a first one of said heating zones to move across a first part of said end surface of said consumable electrode and the other end of said local heating zones to move across the remainder of the end surface of said consumable electrode.

4. Apparatus as claimed in claim 2, wherein said heating means comprises a non-consumable electrode and means for forming an arc between said consumable electrode and said non-consumable electrode.

5. Apparatus according to claim 2, wherein said heating means comprises a plasma torch.

6. Apparatus according to claim 2, wherein said heating means comprises an electron gun.

7. Apparatus according to claim 3, wherein said heating means comprises two non-consumable electrodes and means for forming an arc between said non-consumable electrode and said consumable electrode.

8. Apparatus according to claim 3, wherein said heating means comprises two plasma torches.

9. Apparatus according to claim 2, including an arm, said heating means being carried by said arm extending perpendicular to said axis of said consumable electrode, said arm being fast with a shaft extending parallel to said axis of said consumable electrode, said axis of said shaft being spaced from said axis of said consumable electrode by a distance equal to at least half the radius of said consumable electrode, the length of said arm being equal to the distance separating said axes of said consumable electrode and said shaft, and means for moving said shaft in translation in the direction of its said axis to compensate for consumption of said consumable electrode and for rotating said consumable electrode about its said axis to cause said local heating zone to move along said spiral path.

10. Apparatus according to claim 3, including arms, each said heating means being carried by one of said arms which extends perpendicular to said axis of said consumable electrode, a shaft for each of said arms, each of said arms being fast with said shaft, said shaft extending parallel to said axis of said consumable electrode, an axis of each of said shafts being spaced from said axis of said consumable electrode by a distance equal to at least half the radius of said consumable electrode, the length of each of said arms being equal to the distance separating said axis of said consumable electrode from said axis of said respective shaft, and means for moving said shafts together in translation in the direction of their axes to compensate for consumption of said consumable electrode and for moving said shafts independently in rotation about said axes of said shafts to cause local heating zones to move along said two spiral paths.

11. Apparatus according to claim 6, wherein said electron gun includes a diaphragm, an enclosure for said consumable electrode and said electrode gun, said electron gun further including an electro-magnet, means for energizing said electromagnet to displace an electron beam emitted from said gun to cause said local heating zone produced by said beam to move along said spiral path.

12. Apparatus according to claim 1, including an enclosure for said consumable electrode and said heating means, said enclosure being filled with a gas which is neutral with respect to the metal of said consumable electrode.

13. Apparatus according to claim 1 including an enclosure for said consumable electrode and said heating means walls for said enclosure, said enclosure being constructed and arranged that droplets expelled from said end surface of said consumable electrode are solidified before striking said walls of said enclosure.

* * * * *